US009865203B2

(12) United States Patent
Kim

(10) Patent No.: US 9,865,203 B2
(45) Date of Patent: Jan. 9, 2018

(54) DISPLAY APPARATUS AND METHOD OF DRIVING THE SAME

(71) Applicant: Samsung Display Co., Ltd, Yongin-si, Gyeonggi-do (KR)

(72) Inventor: Jung-won Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 156 days.

(21) Appl. No.: 15/016,111

(22) Filed: Feb. 4, 2016

(65) Prior Publication Data

US 2016/0232860 A1 Aug. 11, 2016

(30) Foreign Application Priority Data

Feb. 5, 2015 (KR) ..... 10-2015-0018107

(51) Int. Cl.

*G09G 5/02* (2006.01)
*G09G 3/36* (2006.01)
*G09G 3/20* (2006.01)

(52) U.S. Cl.

CPC ..... *G09G 3/3607* (2013.01); *G09G 3/2022* (2013.01); *G09G 3/3611* (2013.01); *G09G 3/3648* (2013.01); *G09G 2300/0452* (2013.01); *G09G 2310/0281* (2013.01); *G09G 2310/0283* (2013.01); *G09G 2310/08* (2013.01); *G09G 2320/02* (2013.01); *G09G 2320/028* (2013.01); *G09G 2320/0252* (2013.01); *G09G 2320/068* (2013.01); *G09G 2320/0673* (2013.01)

(58) Field of Classification Search

None

See application file for complete search history.

(56) References Cited

U.S. PATENT DOCUMENTS

| | | | |
|---|---|---|---|
| 8,174,515 | B2 | 5/2012 | Jeong et al. |
| 8,339,425 | B2 | 12/2012 | Shin et al. |
| 8,368,629 | B2 | 2/2013 | Jung et al. |
| 8,502,762 | B2 | 8/2013 | Kamada et al. |

(Continued)

FOREIGN PATENT DOCUMENTS

| | | |
|---|---|---|
| EP | 1959420 2 | 8/2008 |
| EP | 2669882 A2 | 12/2013 |
| JP | 2011-007889 | 1/2011 |

(Continued)

*Primary Examiner* — Ilana Spar
*Assistant Examiner* — Kirk Hermann
(74) *Attorney, Agent, or Firm* — Innovation Counsel LLP

(57) ABSTRACT

A display apparatus includes pixels. A first pixel group of the pixels displays a first grayscale image on the basis of a first gamma curve during three sub-frame periods among consecutive first to fourth sub-frame periods and displays a second grayscale image based on of a second gamma curve during a remaining one sub-frame period of the first to fourth sub-frame periods. A second pixel group of the pixels displays a third grayscale image based on the first gamma curve during three sub-frame periods among the first to fourth sub-frame periods and displays a fourth grayscale image based on the second gamma curve during a remaining one sub-frame period of the first to fourth sub-frame periods. A sub-frame period in which the first pixel group displays the second grayscale image is different from a sub-frame period in which the second pixel group displays the fourth grayscale image.

22 Claims, 14 Drawing Sheets

(56) References Cited

U.S. PATENT DOCUMENTS

| | | | |
|---|---|---|---|
| 2006/0238472 | A1 | 10/2006 | Lee et al. |
| 2014/0002509 | A1 | 1/2014 | Kim et al. |

FOREIGN PATENT DOCUMENTS

| | | | | |
|---|---|---|---|---|
| JP | 2011007889 | A | * | 1/2011 |
| KR | 10-2012-0025187 | A | | 3/2012 |
| KR | 1012229830000 | B1 | | 1/2013 |
| KR | 10-2014-0006404 | A | | 1/2014 |
| KR | 10-2014-0033951 | A | | 3/2014 |

* cited by examiner

DISPLAY APPARATUS AND METHOD OF DRIVING THE SAME

CROSS-REFERENCE TO RELATED APPLICATION

This U.S. non-provisional patent application claims priority under 35 U.S.C. §119 of Korean Patent Application No. 10-2015-0018107, filed on Feb. 5, 2015, the contents of which are hereby incorporated by reference in its entirety.

BACKGROUND

1. Field of Disclosure

The present disclosure relates to a display apparatus and a method of driving the same. More particularly, the present disclosure relates to a display apparatus capable of improving a display quality and a method of driving the display apparatus.

2. Description of the Related Art

In general, a liquid crystal display includes upper and lower substrates each being provided with a transparent electrode, liquid crystals injected between the upper and lower substrates, and upper and lower polarizers respectively disposed on outer surfaces of the upper and lower substrates. The liquid crystal display changes an alignment of the liquid crystals between the upper and lower substrates to control a transmittance of light passing through the liquid crystals.

The liquid crystal display is operated in a horizontal electric field mode or in a vertical alignment mode. In the vertical alignment mode, the liquid crystals are aligned in a direction substantially vertical to the substrates and the liquid crystals rotate when voltages are applied to the upper and lower substrates. Accordingly, an optical axis of a liquid crystal layer moves and polarization of the light is controlled.

The liquid crystal display operated in the vertical alignment mode adopts a structure wherein a pixel is divided into two sub-pixels in order to improve display quality and side visibility. When the pixel is divided into two or more sub-pixels, the number of signal lines and the number of thin film transistors increase since the two sub-pixels are individually driven. As a result, an aperture ratio of the liquid crystal display employing the pixel division structure decreases.

SUMMARY

The present disclosure provides a display apparatus capable of improving an aperture ratio and a display quality.

The present disclosure provides a method of driving the display apparatus.

Embodiments of the inventive concept provide a display apparatus including a plurality of pixels. A first pixel group of the pixels displays a first grayscale image on the basis of a first gamma curve during three sub-frame periods among consecutive first, second, third, and fourth sub-frame periods and displays a second grayscale image on the basis of a second gamma curve during a remaining one sub-frame period of the first, second, third, and fourth sub-frame periods. A second pixel group of the pixels displays a third grayscale image on the basis of the first gamma curve during three sub-frame periods among the first, second, third, and fourth sub-frame periods and displays a fourth grayscale image on the basis of the second gamma curve during a remaining one sub-frame period of the first, second, third, and fourth sub-frame periods.

The sub-frame period in which the first pixel group displays the second grayscale image is different from the sub-frame period in which the second pixel group displays the fourth grayscale image.

Embodiments of the inventive concept provide a driving method of a display apparatus including a plurality of pixels displaying an image during consecutive first, second, third, and fourth sub-frame periods. A first pixel group of the pixels displays a first grayscale image on the basis of a first gamma curve during three sub-frame periods among consecutive first, second, third, and fourth sub-frame periods and displays a second grayscale image on the basis of a second gamma curve during a remaining one sub-frame period of the first, second, third, and fourth sub-frame periods. A second pixel group of the pixels displays a third grayscale image on the basis of the first gamma curve during three sub-frame periods among the first, second, third, and fourth sub-frame periods and displays a fourth grayscale image on the basis of the second gamma curve during a remaining one sub-frame period of the first, second, third, and fourth sub-frame periods. The sub-frame period in which the first pixel group displays the second grayscale image is different from the sub-frame period in which the second pixel group displays the fourth grayscale image.

According to the above, the side visibility of the display apparatus employing the invisible pixel structure may be improved without lowering the aperture ratio of the pixels.

In addition, since the display apparatus is operated in the LLLH interlaced method at a frequency of about 120 Hz, a power consumption of the display apparatus is reduced and the moving line-stain is improved.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

It will be understood that when an element or layer is referred to as being "on", "connected to" or "coupled to" another element or layer, it can be directly on, connected or coupled to the other element or layer or intervening elements or layers may be present.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present inventive concept will be explained in detail with reference to the accompanying drawings.

Figure 1:
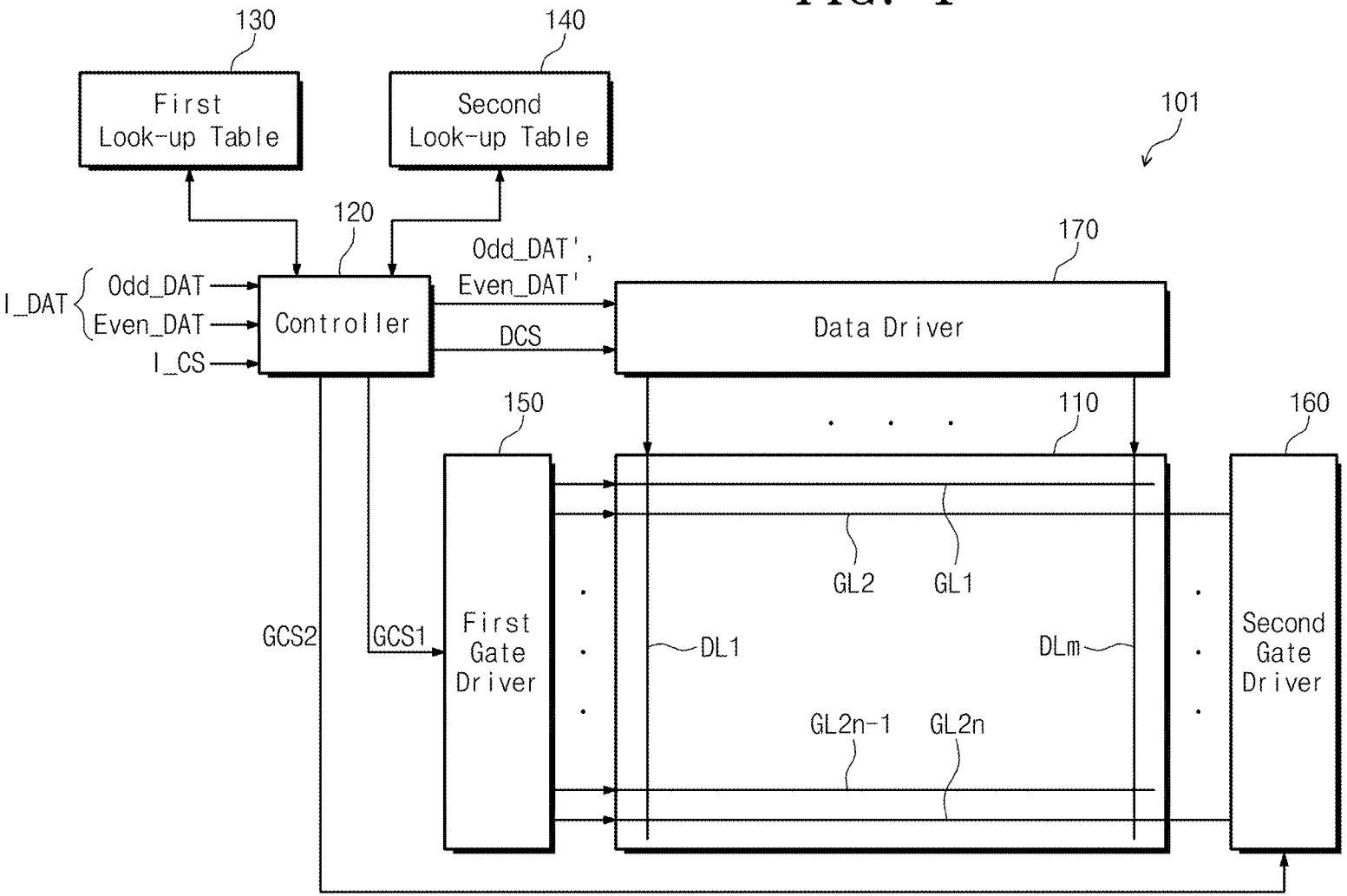
FIG. 1 is a block diagram showing a display apparatus according to an exemplary embodiment of the present disclosure.
Figure 2:
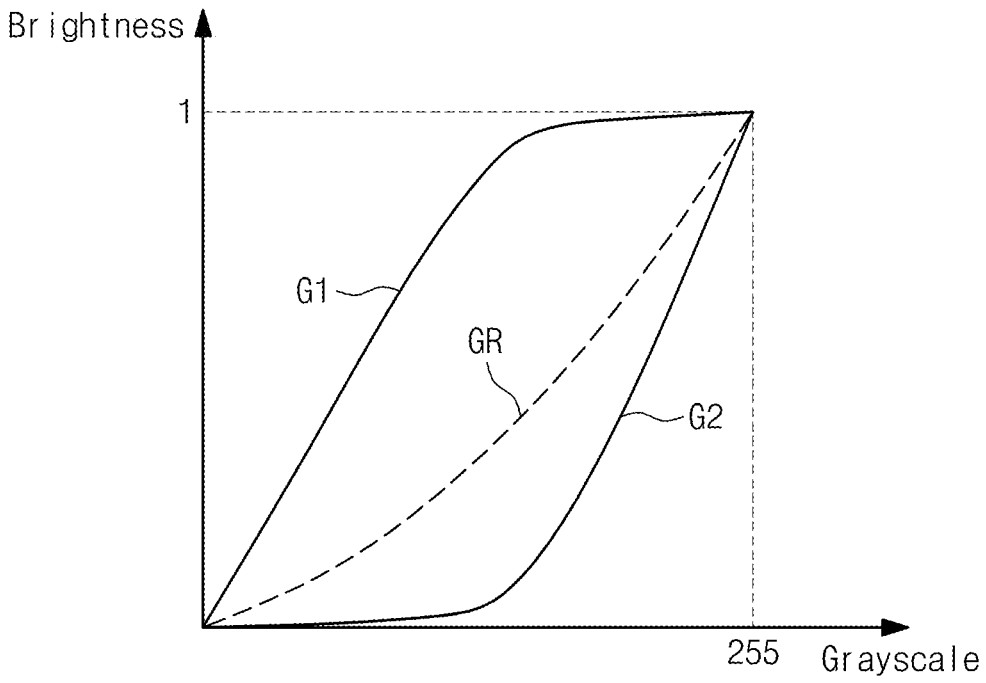
FIG. 2 is a graph showing first and second gamma curves respectively stored in first and second look-up tables shown in FIG. 1.

FIG. 1 is a block diagram showing a display apparatus 101 according to an exemplary embodiment of the present disclosure and FIG. 2 is a graph showing first and second gamma curves respectively stored in first and second look-up tables shown in FIG. 1.

Referring to FIGS. 1 and 2, the display apparatus 101 includes a display panel 110, a controller 120, a first look-up table 130, a second look-up table 140, a first gate driver 150, a second gate driver 160, and a data driver 170.

The display panel 110 includes a plurality of pixels PX each having one color of red, green, and blue colors. The display apparatus 101 is operated in an interlaced mode in which the pixels PX are grouped into two pixel groups, i.e., first and second pixel groups, and the first and second pixel groups are operated during different sub-frame periods.

The controller 120 receives input image data I_DAT and an image control signal I_CS from an external image board (not shown). The input image data I_DAT may correspond to image data signals applied to the display apparatus 101 from the outside of the display apparatus 101. To allow the display apparatus 101 to be operated in the interlaced mode, the input image data I_DAT provided from the image board include first input image data Odd_DAT corresponding to the first pixel group among the pixels PX and second input image data Even_DAT corresponding to the second pixel group among the pixels PX. As an example, the first pixel group includes the pixels positioned at odd-numbered pixel rows and the second pixel group includes the pixels positioned at even-numbered pixel rows. In the present exemplary embodiment, a structure that the first and second pixel groups are alternately arranged with each other in the unit of one pixel row will be described as a representative example, but they should not be limited thereto or thereby. That is, the first and second pixel groups may be alternately arranged with each other in the unit of two or more pixel rows, and in this case, the positions of the pixels included in each of the first and second pixel groups may be changed.

As described above, when the input image data I_DAT are separated into two image data Odd_DAT and Even_DAT and applied to the controller 120, a frame frequency of the display apparatus 101 becomes two times faster when an image is displayed through the display apparatus 101. The display apparatus 101 is operated at the frame frequency of about 120 Hz to display the image.

Each of the pixels PX according to the present exemplary embodiment does not adopt a visible pixel structure. Here, the term of "visible pixel structure" used herein means that one pixel includes two sub-pixels. In this case, one sub-pixel of the two sub-pixels receives high image data having a grayscale higher than that of an input grayscale and the other sub-pixel of the two sub-pixels receives low image data having a grayscale lower than that of the input grayscale. However, each of the pixels PX according to the present exemplary embodiment has what is herein referred to as an "invisible pixel structure" in which each pixel is not separated into two grayscale areas. With the invisible pixel structure, an aperture ratio of each pixel PX may be improved compared to that of the visible pixel structure.

However, to improve the side visibility of the display apparatus 101 employing the invisible pixel structure, the display apparatus 101 may be operated in a time gamma mixed (TGM) driving method. According to the TGM driving method, one frame period is divided into at least two sub-frame periods, the high image data are applied to the pixels PX during one sub-frame period, and the low image data are applied to the pixels PX during the other sub-frame periods.

Hereinafter, a method of driving the display apparatus 101 using the interlaced method and the TGM driving method will be described in detail.

The first look-up table 130 stores first sampling data sampled from a first gamma curve G1 shown in FIG. 2 and the second look-up table 140 stores second sampling data sampled from a second gamma curve G2 shown in FIG. 2.

In FIG. 2, an x-axis represents the grayscale and a y-axis represents a brightness (or transmittance (%)). As viewed relative to the same grayscale, the first gamma curve G1 has the brightness higher than that of the second gamma curve G2.

FIG. 2 shows a reference gamma curve GR representing an optimized front visibility. For instance, the reference gamma curve GR has a gamma value of about 2.2. The first gamma curve G1 has a brightness higher than that of the reference gamma curve GR at the same grayscale and the second gamma curve G2 has the brightness lower than that of the reference gamma curve GR at the same grayscale. The first and second gamma curves G1 and G2 may be gamma curves optimized to the side visibility of the display panel 110. The first and second gamma curves G1 and G2 may be generated to calculate the reference gamma curve GR when the first and second gamma curves G1 and G2 are added to each other.

The shape of the first and second gamma curves G1 and G2 should not be limited to FIG. 2.

Accordingly, when the display panel 110 displays the image using data converted on the basis of the second gamma curve G2, the display panel 110 displays the image with the brightness lower than that when the display panel 110 displays the image with data converted on the basis of the first gamma curve G1. The first look-up table 130 stores high grayscale brightness data extracted from the first gamma curve G1 among predetermined reference grayscales as the first sampling data. The second look-up table 140 stores low grayscale brightness data extracted from the second gamma curve G2 among the predetermined reference grayscales as the second sampling data.

The controller 120 reads out the first and second sampling data from the first and second look-up tables 130 and 140 and converts the first and second input image data Odd_DAT and Even_DAT. Each of the first and second input image data Odd_DAT and Even_DAT include red, green, and blue image data R, G, and B. First and second converted image data Odd_DAT' and Even_DAT' generated by the controller 120 are provided to the data driver 170. The first and second converted image data Odd_DAT' and Even_DAT' may include information about gamma curve.

The controller 120 generates a first gate control signal GCS1, a second gate control signal GCS2, and a data control signal DCS in response to the image control signal I_CS. The first gate driver 150 receives the first gate control signal GCS1 from the controller 120, generates odd-numbered gate signals in response to the first gate control signal GCS1, and applies the odd-numbered gate signals to the display panel 110. The second gate driver 160 receives the second gate control signal GCS2 from the controller 120, generates even-numbered gate signals in response to the second gate control signal GCS2, and applies the even-numbered gate signals to the display panel 110. The data driver 170 receives the first and second converted image data Odd_DAT' and Even_DAT' and the data control signal DCS from the controller 120 and applies data signal to the display panel 110 in response to the first and second converted image data Odd_DAT' and Even_DAT' and the data control signal DCS.

The display panel 110 includes a plurality of gate lines GL1 to GL2*n* and a plurality of data lines DL1 to DLm. Among the gate lines GL1 to GL2*n*, odd-numbered gate lines are connected to the first gate driver 150 to receive the odd-numbered gate signals and even-numbered gate lines are connected to the second gate driver 160 to receive the even-numbered gate signals. The data lines DL1 to DLm receive the data signals from the data driver 170. Each of the pixels PX included in the display panel 110 is connected to a corresponding gate line of the gate lines GL1 to GL2*n* and a corresponding data line of the data lines DL1 to DLm. Therefore, the pixels PX display the image in response to the gate signals and the data signals.

Figure 3:
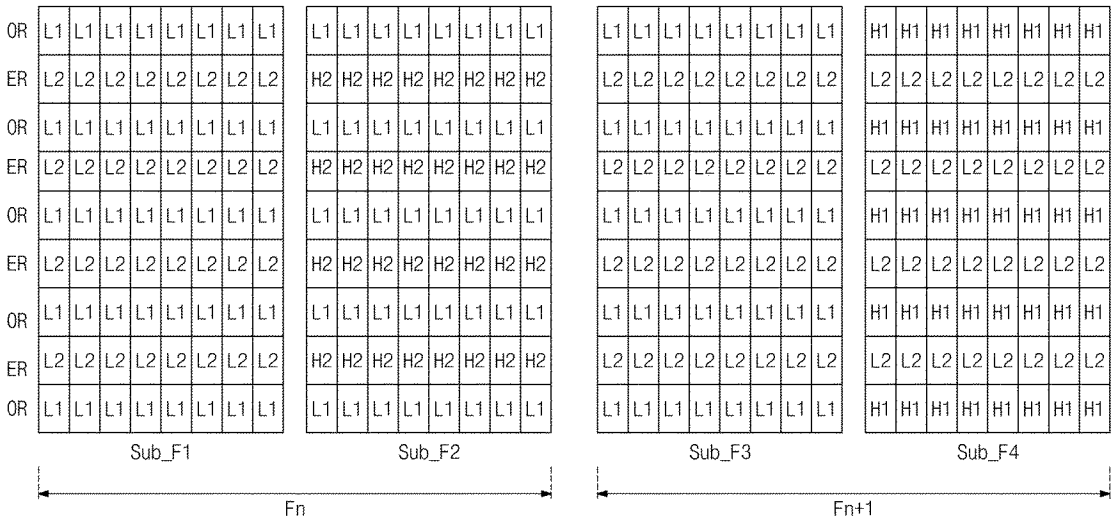
FIG. 3 is a plan view showing an operation state of pixels during consecutive first and second frame periods.

FIG. 3 is a plan view showing an operation state of pixels during consecutive first and second frame periods Fn and Fn+1.

Referring to FIG. 3, the display apparatus 101 drives the pixels during consecutive first and second frame periods Fn and Fn+1 to display the image. The first frame period Fn includes first and second sub-frame periods Sub_F1 and Sub_F2 and the second frame period Fn+1 includes third and fourth sub-frame periods Sub_F3 and Sub_F4.

Among the pixels PX, the first pixel group displays a first grayscale image L1 using a first image signal generated on the basis of the first gamma curve G1 (refer to FIG. 2) during three sub-frame periods of the first to fourth sub-frames Sub_F1 to Sub_F4. The first pixel group displays a second grayscale image H1 using a second image signal generated on the basis of the second gamma curve G2 (refer to FIG. 2) during remaining one sub-frame period of the first to fourth sub-frames Sub_F1 to Sub_F4.

Among the pixels PX, the second pixel group displays a third grayscale image L2 using a third image signal generated on the basis of the first gamma curve G1 during three sub-frame periods of the first to fourth sub-frames Sub_F1 to Sub_F4. The second pixel group displays a fourth grayscale image H2 using a fourth image signal generated on the basis of the second gamma curve G2 during remaining one sub-frame period of the first to fourth sub-frames Sub_F1 to Sub_F4.

Among the pixels PX, the first pixel group includes the pixels positioned at odd-numbered pixel rows OR and the second pixel group includes the pixels positioned at even-numbered pixel rows ER.

As an example, the first pixel group displays the first grayscale image L1 during the first to third sub-frame periods Sub_F1 to Sub_F3 and displays the second grayscale image H1 during the fourth sub-frame period Sub_F4. The second pixel group displays the third grayscale image L2 during the first, third, and fourth sub-frame periods Sub_F1, Sub_F3, and Sub_F4 and displays the fourth grayscale image H2 during the second sub-frame period Sub_F2. As described above, the sub-frame period, i.e., the fourth sub-frame period Sub_F4, in which the first pixel group displays the second grayscale image H4, is different from the sub-frame, i.e., the second sub-frame period Sub_F2, in which the second pixel group displays the fourth grayscale image H2.

The odd-numbered pixel rows OR are sequentially turned on along a column direction during the first sub-frame period Sub_F1 to display the first grayscale image L1. Then, the odd-numbered pixel rows OR maintain the first grayscale image L1 during the second and third sub-frame periods Sub_F2 and Sub_F3.

The even-numbered pixel rows ER are sequentially turned on along the column direction during the second sub-frame period Sub_F2 to display the fourth grayscale image H2. Then, the even-numbered pixel rows ER are sequentially turned on along the column direction during the third sub-frame period Sub_F3 to display the third grayscale image L2 and maintain the third grayscale image L2 during the fourth sub-frame period Sub_F4.

Each of the first and second frame periods Fn and Fn+1 has a period width of about 1/60 (ms) and each of the first to fourth sub-frame periods Sub_F1 to Sub_F4 has a period width of about 1/120 (ms).

Thus, during the consecutive first and second frame periods Fn and Fn+1, the odd-numbered pixel rows OR display the image in order of L1, L1, L1, and H1 (L1->L1->L1->H1) and the even-numbered pixel rows ER display the image in order of L2, H2, L2, and L2 (L2->H2->L2->L2). However, the display order of the images should not be limited thereto or thereby as long as the second and fourth grayscale images H1 and H2 having the high grayscale are displayed during one sub-frame period and the first and third grayscale images L1 and L2 having the low grayscale are displayed during three sub-frame periods.

As described earlier, each pixel of the first pixel group displays the first grayscale image L1 and the second grayscale image H1 during the first to fourth sub-frame periods Sub_F1 to Sub_F4 to allow a time difference to exist between the first and second grayscale images L1 and H1. Accordingly, the side visibility is improved even though each pixel does not employ the visible pixel structure. In addition, each pixel of the second pixel group displays the third grayscale image L2 and the fourth grayscale image H2 during the first to fourth sub-frame periods Sub_F1 to Sub_F4 to allow a time difference to exist between the third and fourth grayscale images L2 and H2. Therefore, the side visibility of the display apparatus 101 may be improved without lowering the aperture ratio of each pixel PX of the display apparatus 101.

Figure 4A:
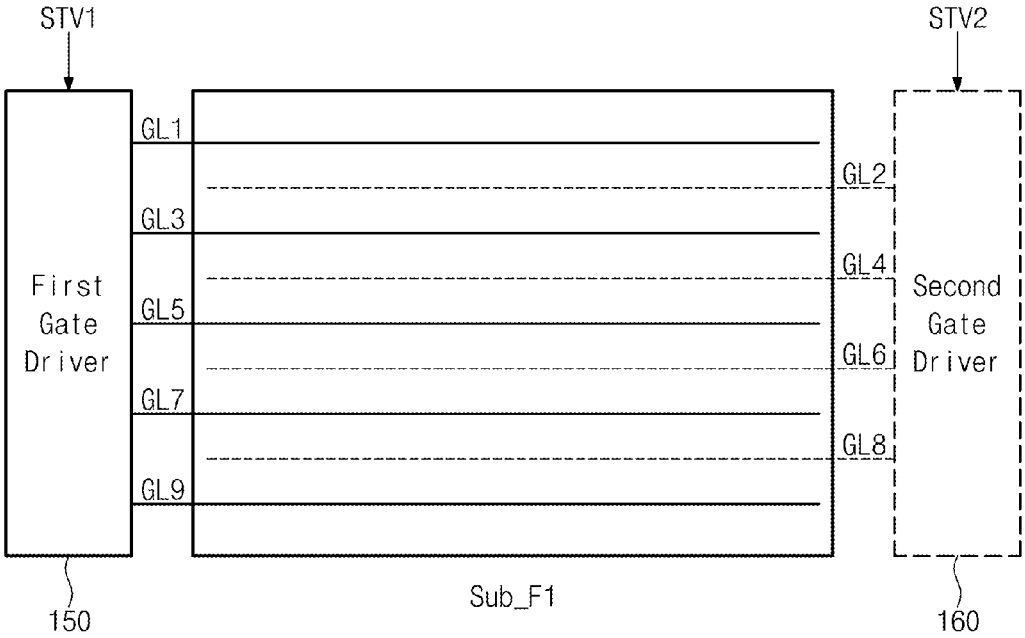
FIGS. 4A, 4B, 4C, and 4D are views showing a relation between an operation of first and second gate drivers shown in FIGS. 1 and 3 and sub-frames.
Figure 4B:
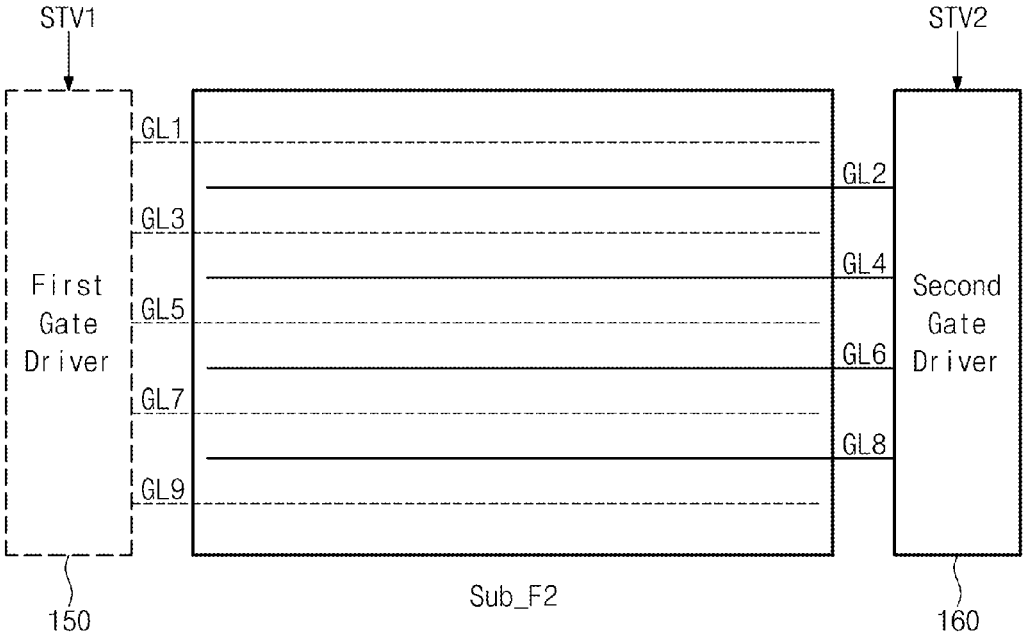
Figure 4C:
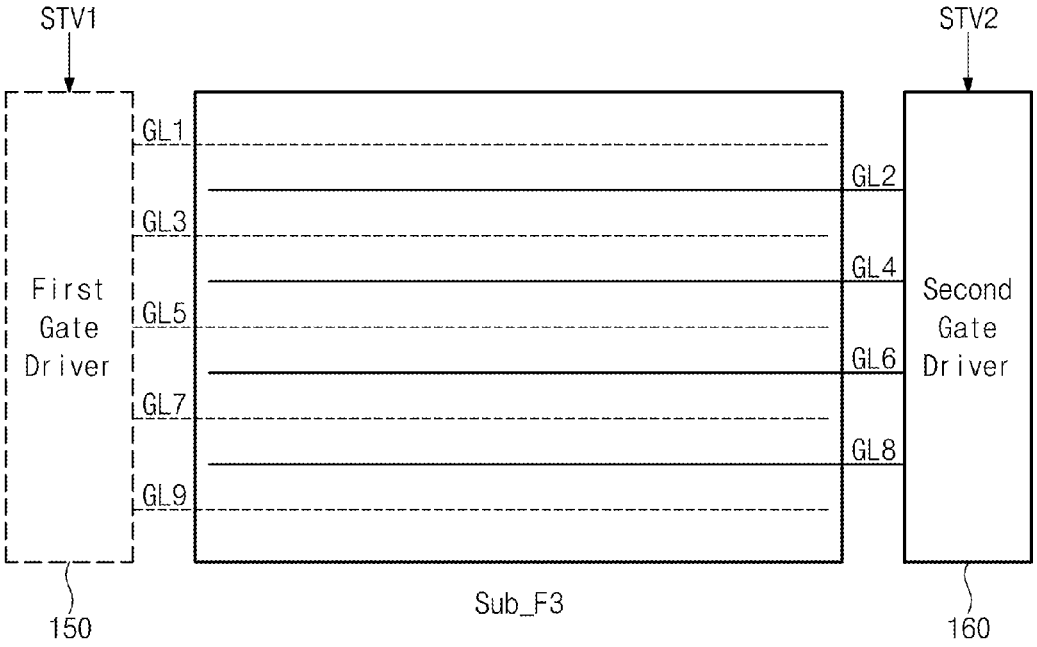
Figure 4D:
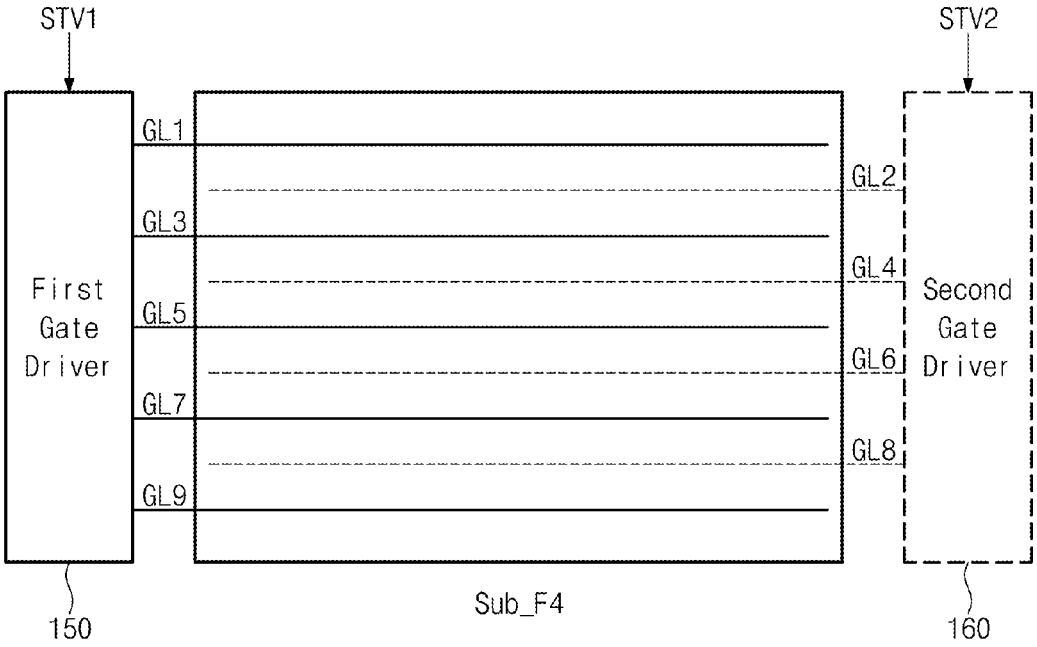
Figure 5:
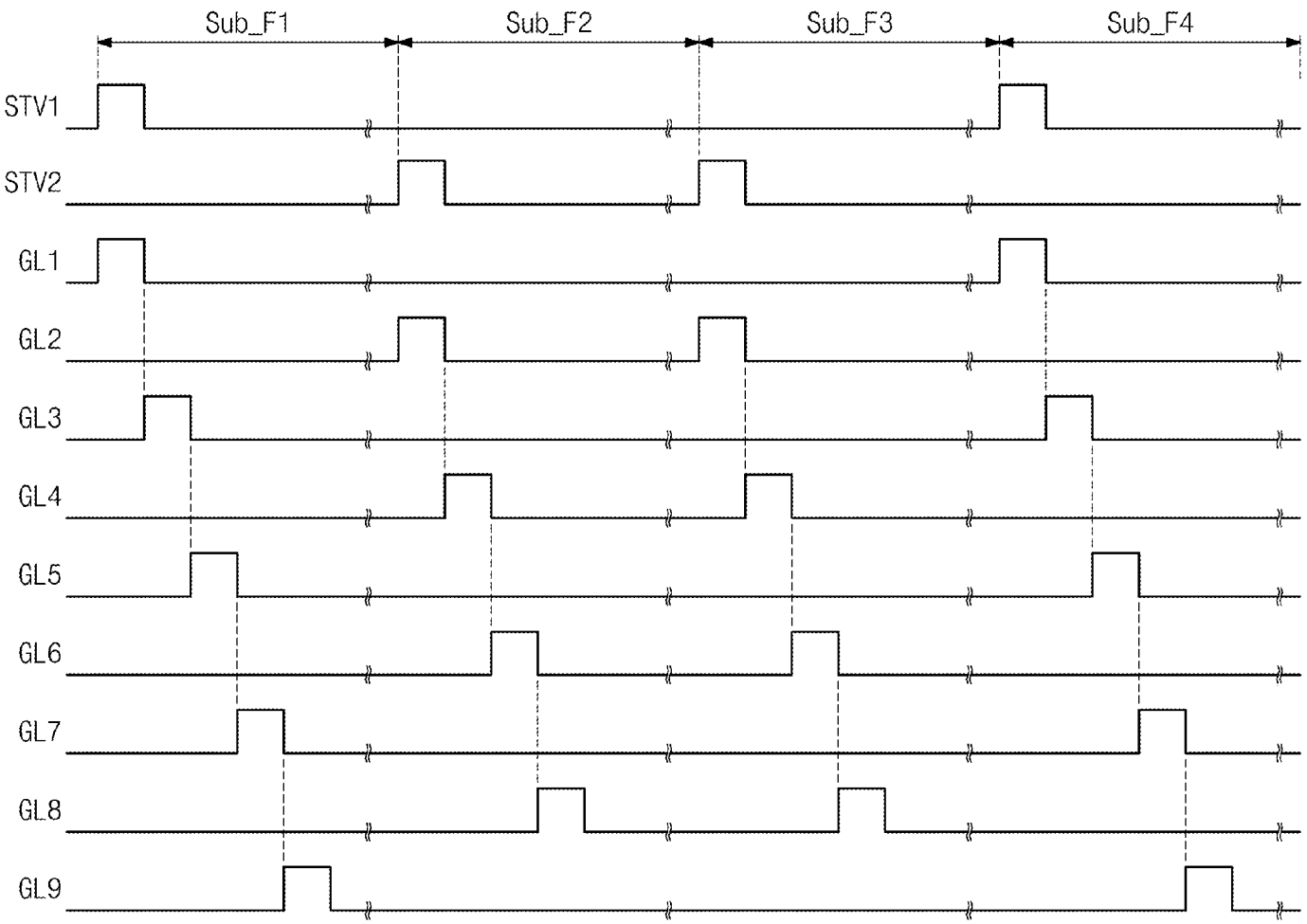
FIG. 5 is a waveform diagram showing first and second vertical start signals and first to ninth gate signals shown in FIGS. 4A to 4D.

FIGS. 4A to 4D are views showing a relation between an operation of the first and second gate drivers 150 and 160 shown in FIGS. 1 and 3 and the sub-frames and FIG. 5 is a waveform diagram showing first and second vertical start signals STV1 and STV2 and first to ninth gate signals GL1 to GL9 shown in FIGS. 4A to 4D.

Referring to FIG. 4A, the first gate driver 150 is operated during the first sub-frame period Sub_F1 and sequentially applies the odd-numbered gate signals (hereinafter, referred to as first, third, fifth, seventh, and ninth gate signals) to the odd-numbered gate lines GL1, GL3, GL5, GL7, and GL9 (hereinafter, referred to as first, third, fifth, seventh, and ninth gate lines) among the gate lines GL1 to GL2*n*. The second gate driver 160 is turned on during the first sub-frame period Sub_F1.

The first gate driver 150 is connected to the first, third, fifth, seventh, and ninth gate lines GL1, GL3, GL5, GL7, and GL9 among the gate lines GL1 to GL2*n* and the second gate driver 160 is connected to the even-numbered gate lines GL2, GL3, GL6, and GL8 (hereinafter, referred to as second, fourth, sixth, and eighth gate lines) among the gate lines GL1 to GL2*n*. The first gate driver 150 receives the first vertical start signal STV1 from the controller 110 (refer to FIG. 1) and the second gate driver 160 receives the second vertical start signal STV2 from the controller 110. The first vertical start signal STV1 is one of signals included in the first gate control signal GCS1 and the second vertical start signal STV2 is one of signals included in the second gate control signal GCS2.

As shown in FIG. 5, the first vertical start signal STV1 is generated in a high state at a start time point of the first sub-frame period Sub_F1. Accordingly, when the first sub-frame period Sub_F1 starts, the first gate driver 150 starts its operation. The first gate driver 150 sequentially applies the first, third, fifth, seventh, and ninth gate signals to the first, third, fifth, seventh, and ninth gate lines GL1, GL3, GL5, GL7, and GL9 during the first sub-frame period Sub_F1. A high period, i.e., a horizontal scan period 1H, of each of the first, third, fifth, seventh, and ninth gate signals may be smaller than a value obtained by dividing the period width of the first sub-frame period Sub_F1 by the number of the odd-numbered gate lines, i.e., n number of the odd-numbered gate lines.

Therefore, the pixels of the odd-numbered pixel rows connected to the odd-numbered gate lines GL1, GL3, GL5, GL7, and GL9 receive a data signal corresponding to the first grayscale image L1 from the data driver 170.

During the first sub-frame period Sub_F1, the second vertical start signal STV2 is maintained in a low state. Thus, the second gate driver 160 is maintained in the turned-off state. Accordingly, a new data signal is not applied to the pixels of the even-numbered pixel rows connected to the even-numbered gate lines GL2, GL4, GL6, and GL8, and thus the pixels of the even-numbered pixel rows maintain the data signal previously applied thereto.

Referring to FIGS. 4B and 5, the second gate driver 160 is operated in response to the second vertical start signal STV2 and the first gate driver 150 is turned off.

The second vertical start signal STV2 is generated in a high state at a start time point of the second sub-frame period Sub_F2. Accordingly, when the second sub-frame period Sub_F2 starts, the second gate driver 160 starts its operation. The second gate driver 160 sequentially applies the second, fourth, sixth, and eighth gate signals to the second, fourth, sixth, and eighth gate lines GL2, GL4, GL6, and GL8 during the second sub-frame period Sub_F2. A high period, i.e., the horizontal scan period 1H, of each of the second, fourth, sixth, and eighth gate signals may be smaller than a value obtained by dividing the period width of the second sub-frame period Sub_F2 by the number of the even-numbered gate lines, i.e., n number of the even-numbered gate lines.

Therefore, the pixels of the even-numbered pixel rows connected to the even-numbered gate lines GL2, GL4, GL6, and GL8 receive a data signal corresponding to the fourth grayscale image H2 from the data driver 170.

During the second sub-frame period Sub_F2, the first vertical start signal STV1 is maintained in the low state. Thus, the first gate driver 150 is maintained in the turned-off state. Accordingly, a new data signal is not applied to the pixels of the odd-numbered pixel rows connected to the odd-numbered gate lines GL1, GL3, GL5, GL7, and GL9, and thus the pixels of the odd-numbered pixel rows maintain the data signal previously applied thereto.

Referring to FIGS. 4C and 5, the second vertical start signal STV2 is generated in the high state at a start time point of the third sub-frame period Sub_F3. Accordingly, when the third sub-frame period Sub_F3 starts, the second gate driver 160 starts its operation. The second gate driver 160 sequentially applies the second, fourth, sixth, and eighth gate signals to the second, fourth, sixth, and eighth gate lines GL2, GL4, GL6, and GL8 during the third sub-frame period Sub_F3.

Therefore, the pixels of the even-numbered pixel rows connected to the even-numbered gate lines GL2, GL4, GL6, and GL8 receive a data signal corresponding to the third grayscale image L2 from the data driver 170.

During the third sub-frame period Sub_F3, the first vertical start signal STV1 is maintained in the low state and the first gate driver 150 is maintained in the turned-off state. Accordingly, a new data signal is not applied to the pixels of the odd-numbered pixel rows connected to the odd-numbered gate lines GL1, GL3, GL5, GL7, and GL9, and thus the pixels of the odd-numbered pixel rows maintain the data signal previously applied thereto.

Referring to FIGS. 4D and 5, the first vertical start signal STV1 is in the high state at the start of the fourth sub-frame period Sub_F4. Accordingly, the first gate driver 150 starts its operation when the fourth sub-frame period Sub_F4 starts. The first gate driver 150 sequentially applies the first, third, fifth, seventh, and ninth gate signals to the first, third, fifth, seventh, and ninth gate lines GL1, GL3, GL5, GL7, and GL9 during the fourth sub-frame period Sub_F4.

Therefore, the pixels of the odd-numbered pixel rows connected to the odd-numbered gate lines GL1, GL3, GL5, GL7, and GL9 receive a data signal corresponding to the second grayscale image H2 from the data driver 170.

During the fourth sub-frame period Sub_F4, the second vertical start signal STV2 is maintained in the low state and the second gate driver 160 is maintained in the turned-off state. Accordingly, a new data signal is not applied to the pixels of the even-numbered pixel rows connected to the even-numbered gate lines GL2, GL4, GL6, and GL8, and thus the pixels of the even-numbered pixel rows maintain the data signal that was previously received.

Figure 6A:
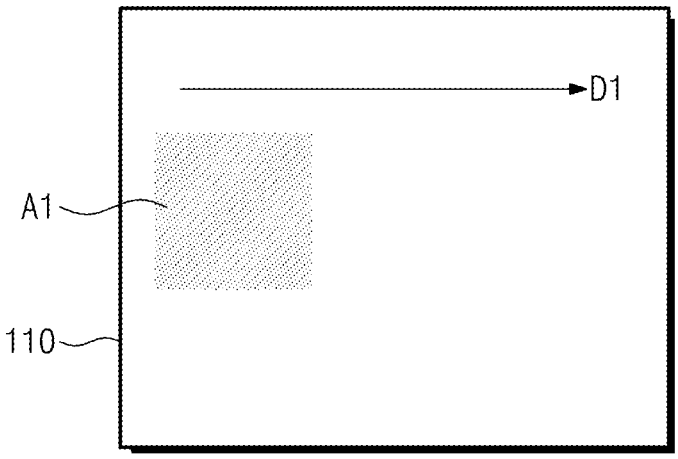
FIG. 6A is a view showing a movement of a quadrangular gray pattern on a display screen of a display panel.
Figure 6B:
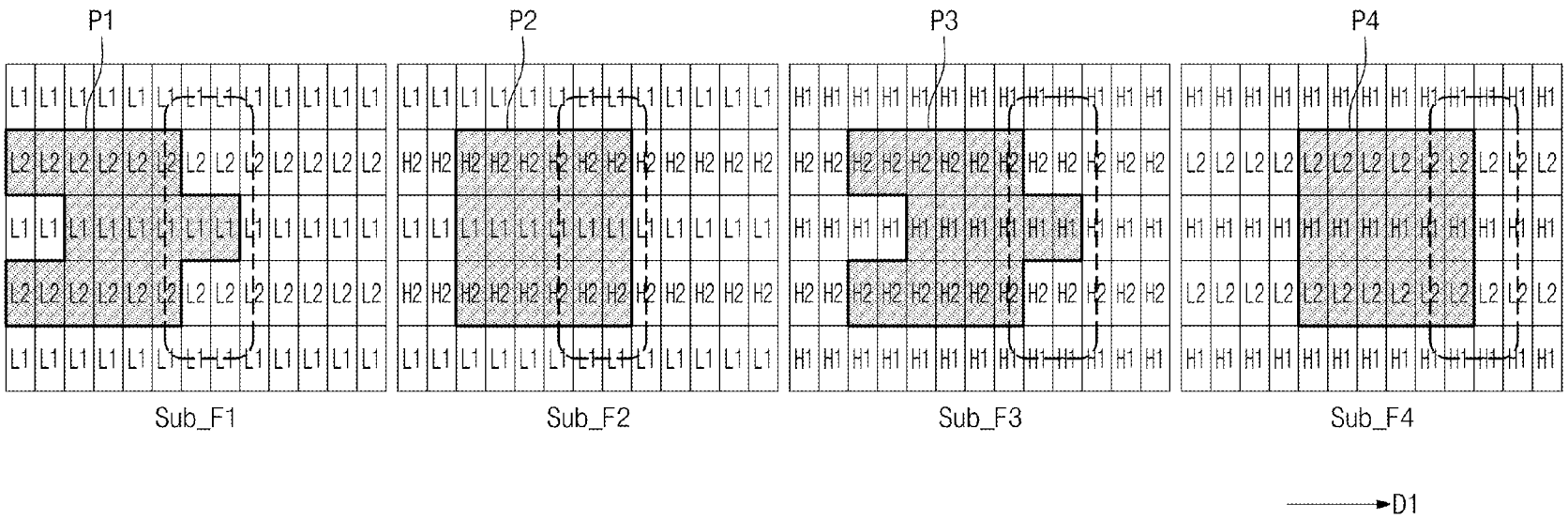
FIG. 6B is a view showing a moving line-stain occurring in an LHLH interlaced scheme.
Figure 6C:
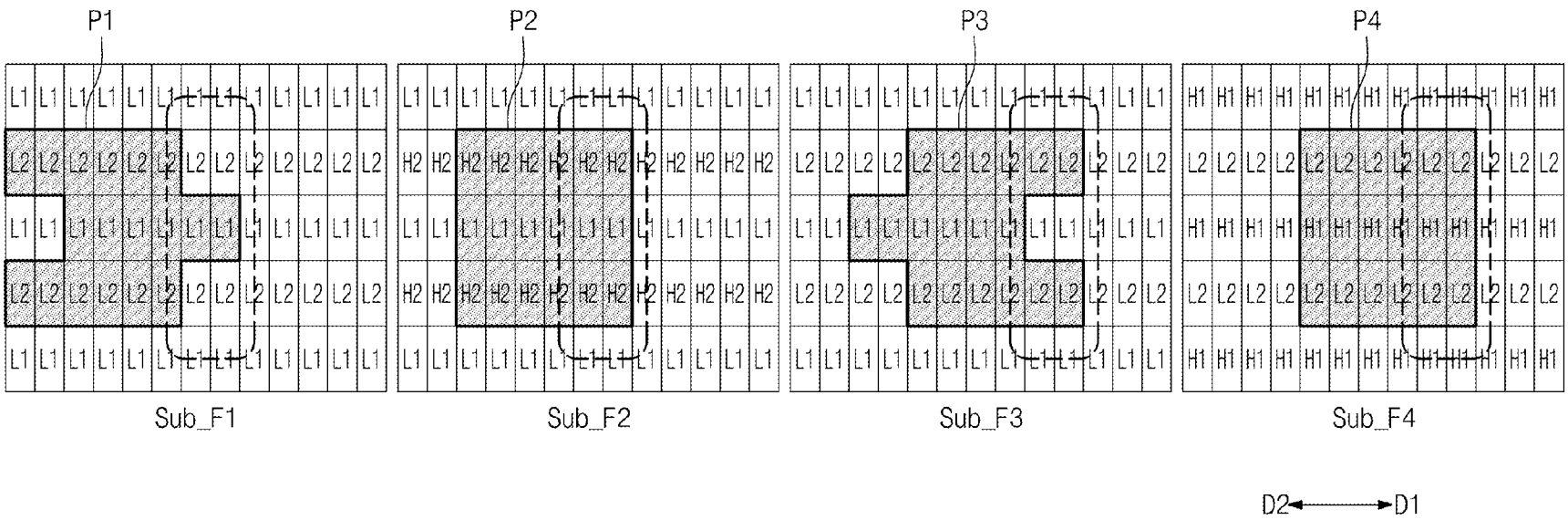
FIG. 6C is a view showing a moving line-stain removed in an LLLH interlaced scheme.

FIG. 6A is a view showing a movement of a quadrangular gray pattern on a display screen of a display panel, FIG. 6B is a view showing a moving line-stain occurring in an LHLH interlaced scheme, and FIG. 6C is a view showing a moving line-stain removed in an LLLH interlaced scheme.

Referring to FIGS. 6A and 6B, a quadrangular gray pattern A1 is displayed on a white screen of the display panel 110. The quadrangular gray pattern A1 is assumed to move in a first direction D1 every one sub-frame period in the unit of two pixels.

The display apparatus 101 displays the first grayscale image L1 through the odd-numbered pixel rows OR during the first sub-frame period Sub_F1 and displays the fourth grayscale image H2 through the even-numbered pixel rows ER during the second sub-frame period Sub_F2. The display apparatus 101 displays the second grayscale image H1 through the odd-numbered pixel rows OR during the third sub-frame period Sub_F3 and displays the third grayscale image L2 through the even-numbered pixel rows ER during the fourth sub-frame period Sub_F4.

As described above, the quadrangular gray pattern A1 may be displayed as first, second, third, and fourth patterns P1, P2, P3, and P4, shown in graph in FIG. 6B and FIG. 6C. The first, second, third, and fourth patterns P1, P2, P3, and P4 are displayed during the first to fourth sub-frame periods Sub_F1 to Sub_F4, respectively, when the LLHH interlaced method is applied to the display apparatus 101. In particular, a left boundary of the first pattern P1 is displayed in a shape recessed in the first direction D1 in the first sub-frame period Sub_F1 and a boundary between a white area and a pattern area is not displayed in a straight line shape. A right boundary of the first pattern P1 is protruded in the first direction D1 without being displayed in the straight line shape. During the second and fourth sub-frame periods Sub_F2 and Sub_F4, the second and fourth patterns P2 and P4 are displayed in the same quadrangular shape as the quadrangular gray pattern A1. However, the third pattern P3 in the third sub-frame period Sub_F3 is distorted similar to the shape of the first pattern P1 in the first sub-frame period Sub_F1. Accordingly, the quadrangular gray pattern A1 may be perceived as the distorted shape similar to the first and third patterns P1 and P3. The distortion in the shape of the patterns causes a brightness stain at the left and right boundaries, which is called the "moving line-stain."

However, when the display apparatus 101 is operated in the LLHH interlaced driving method shown in FIGS. 1 to 5, the quadrangular gray pattern A1 is displayed in the shape shown in FIG. 6C during the first to fourth sub-frame periods Sub_F1 to Sub_F4. According to the LLHH interlaced driving method, the pixels of the first pixel group are operated in an i-th sub-frame period Sub_F1 and an (i+2)th sub-frame period Sub_F3 among consecutive four sub-frame periods Sub_F1 to Sub_F4 to display the first and second grayscale images L1 and H1, respectively, and the pixels of the second pixel group are operated in an (i+1)th sub-frame period Sub_F2 and an (i+2)th sub-frame period Sub_F3 among the consecutive four sub-frame periods Sub_F1 to Sub_F4 to display the fourth and third grayscale images H2 and L2, respectively.

Referring to FIG. 6C, when the LLLH interlaced driving method is applied to the display apparatus 101, the boundary between the white area and the pattern area is distorted without being displayed in the straight line shape at the left and right boundaries of the first and third patterns P1 and P3 of the first and third sub-frame periods Sub_F1 and Sub_F3. However, the distorted shape of the first pattern P1 in the first sub-frame period Sub_F1 is different from the distorted shape of the third pattern P3 in the third sub-frame period Sub_F3. In detail, when the left boundary of the first pattern P1 in the first sub-frame period Sub_F1 is displayed in the shape recessed in the first direction D1, the left boundary of the third pattern P3 of the third sub-frame period Sub_F3 is displayed in the shape protruded in a second direction D2 opposite the first direction D1. Similarly, when the right boundary of the first pattern P1 in the first sub-frame period Sub_F1 is displayed in the shape protruded in the first direction D1, the right boundary of the third pattern P3 in the third sub-frame period Sub_F3 is displayed in the shape recessed in the second direction D2 opposite to the first direction D1.

When the first pattern P1 in the first sub-frame period Sub_F1 and the third pattern P3 in the third sub-frame period Sub_F3 are added to each other, the brightness stain of the first pattern P1 is offset with the brightness stain of the third pattern P3 at the left and right boundaries. Therefore, the stain caused by the movement of the quadrangular gray pattern may be removed in the LLLH interlaced driving method.

Figure 7:
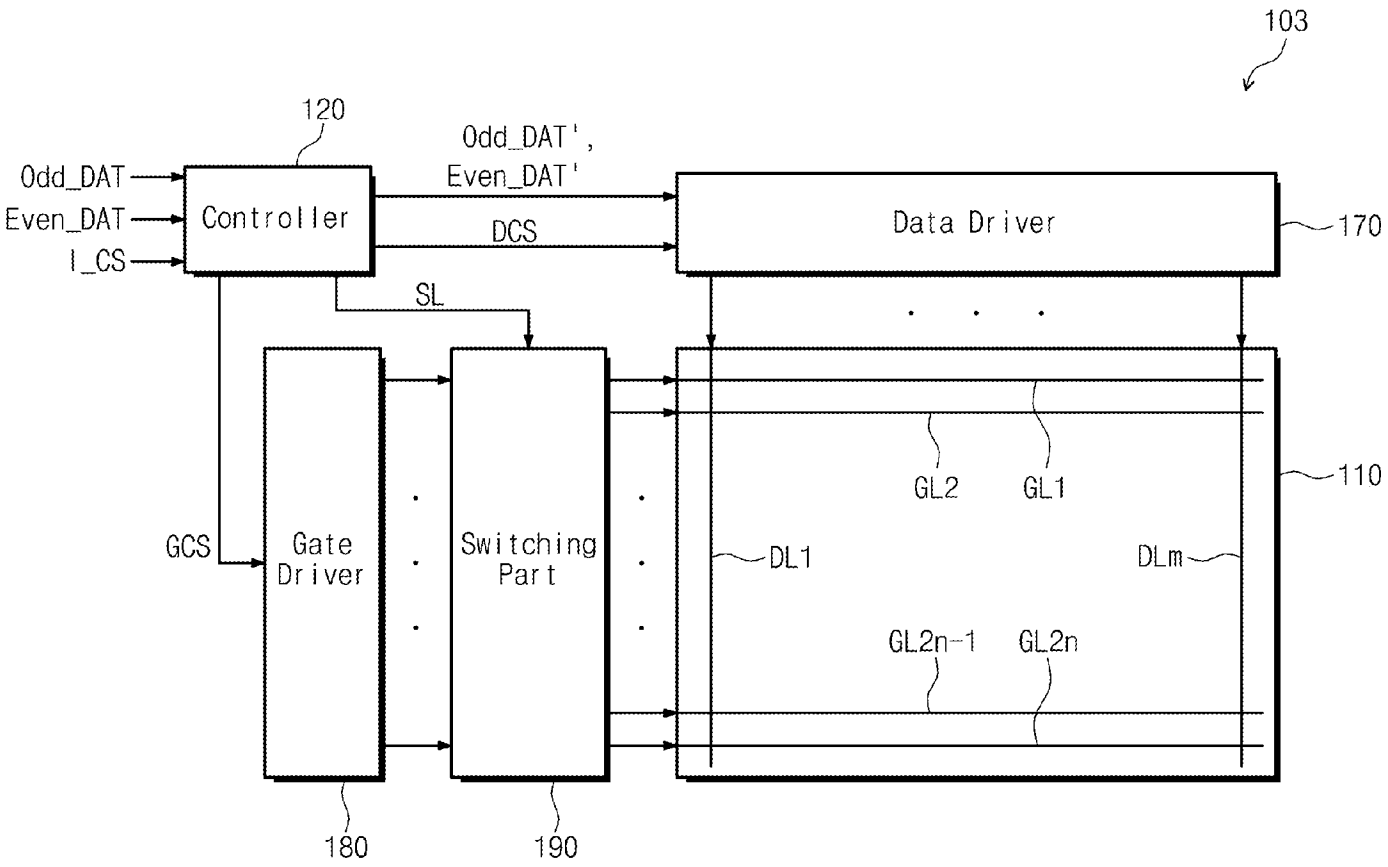
FIG. 7 is a block diagram showing a display apparatus according to another exemplary embodiment of the present disclosure.

FIG. 7 is a block diagram showing a display apparatus 103 according to another exemplary embodiment of the present disclosure. In FIG. 7, the same reference numerals denote the same elements in FIG. 1, and thus detailed descriptions of the same elements will be omitted.

Referring to FIG. 7, the display apparatus 103 includes a display panel 110, a controller 120, a gate driver 180, a switching part 190, and a data driver 170.

The controller 120 generates a gate control signal GCS, a data control signal DCS, and a selection signal SL in response to the image control signal I_CS. The gate driver 180 receives the gate control signal GCS from the controller 120 and generates n gate signals in response to the gate control signal GCS. The switching part 190 receives the selection signal SL and selects a group of n odd-numbered gate lines or a group of n even-numbered gate lines among 2n gate lines GL1 to GLn in response to the selection signal. Accordingly, the n gate signals output from the gate driver 180 may be applied to the n gate lines selected by the switching part 190.

The data driver 170 receives first and second converted image data Odd_DAT' and Even_DAT' and the data control signal DCS and outputs data signals to the display panel 110 in response to the first and second converted image data Odd_DAT' and Even_DAT' and the data control signal DCS. The data driver 170 receives one of the first and second converted image data Odd_DAT' and Even_DAT' in synchronization with the operation with the switching part 190.

Figure 8A:
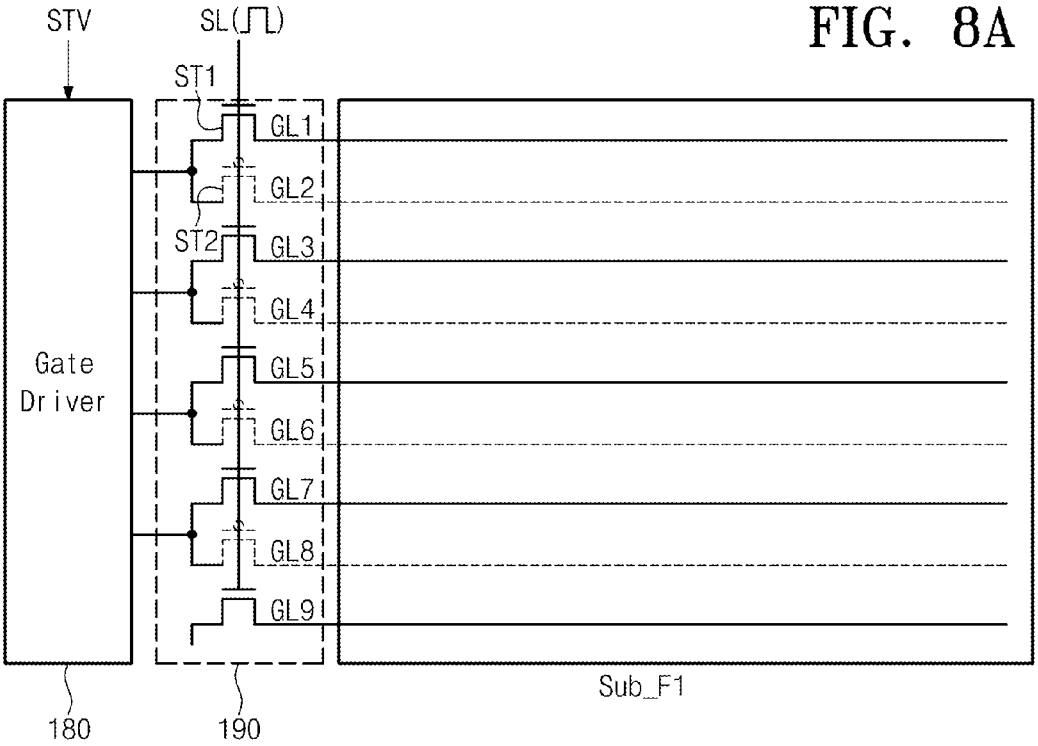
FIGS. 8A, 8B, 8C, and 8D are views showing a relation between sub-frames and an operation of a gate driver and a switching part shown in FIG. 7.
Figure 8B:
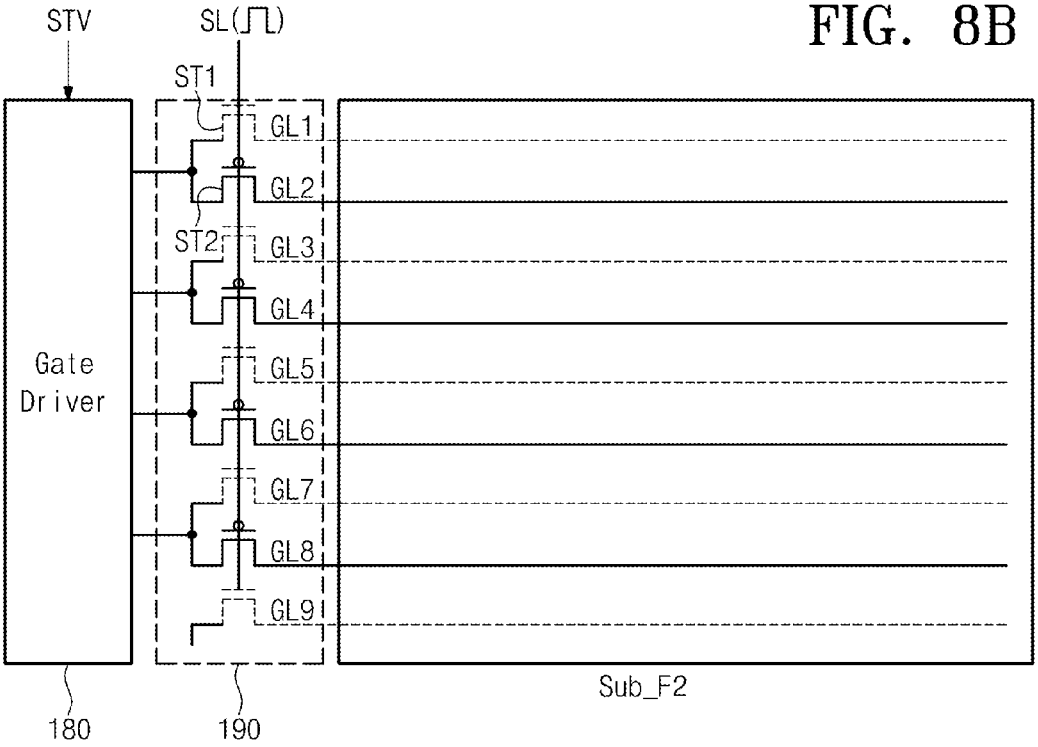
Figure 8C:
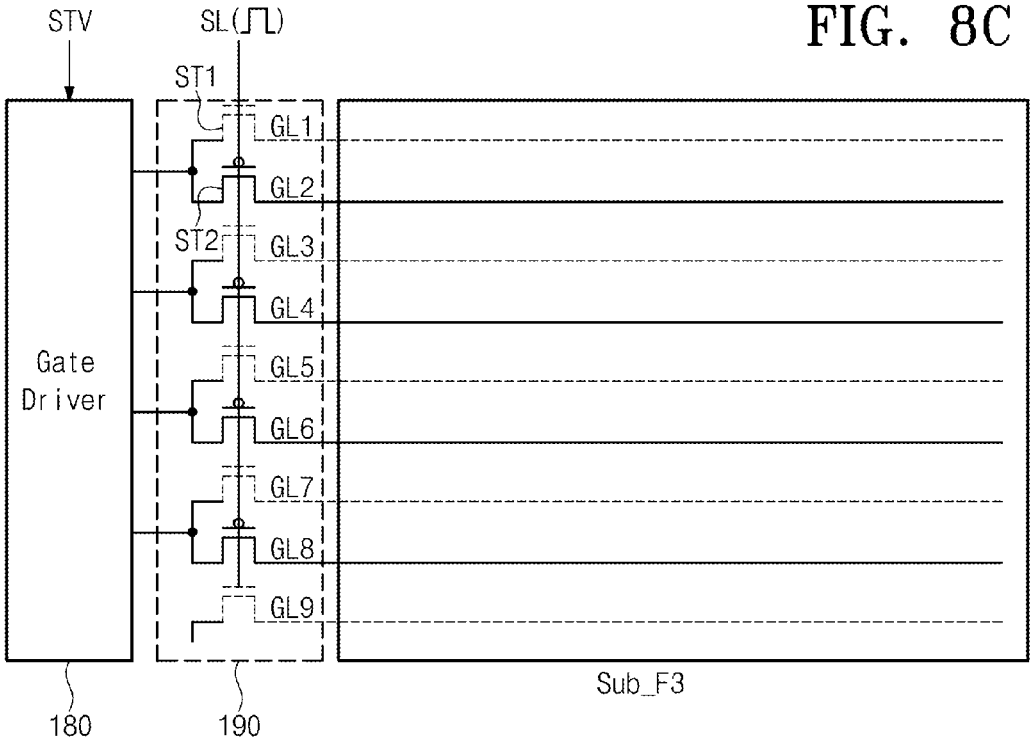
Figure 8D:
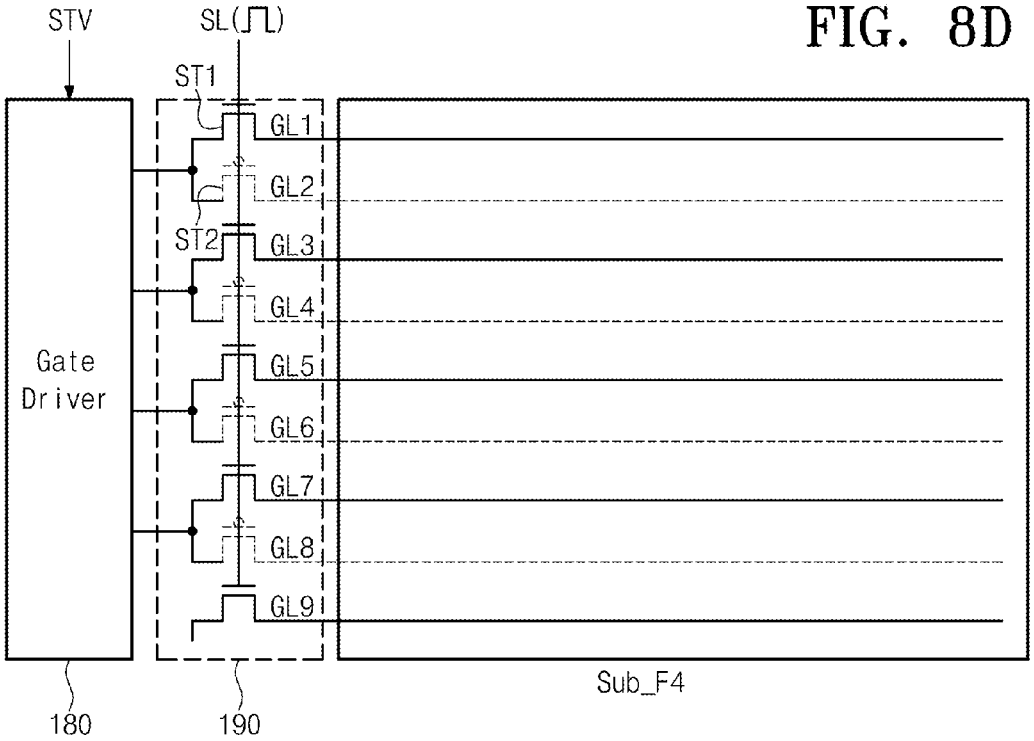
Figure 9:
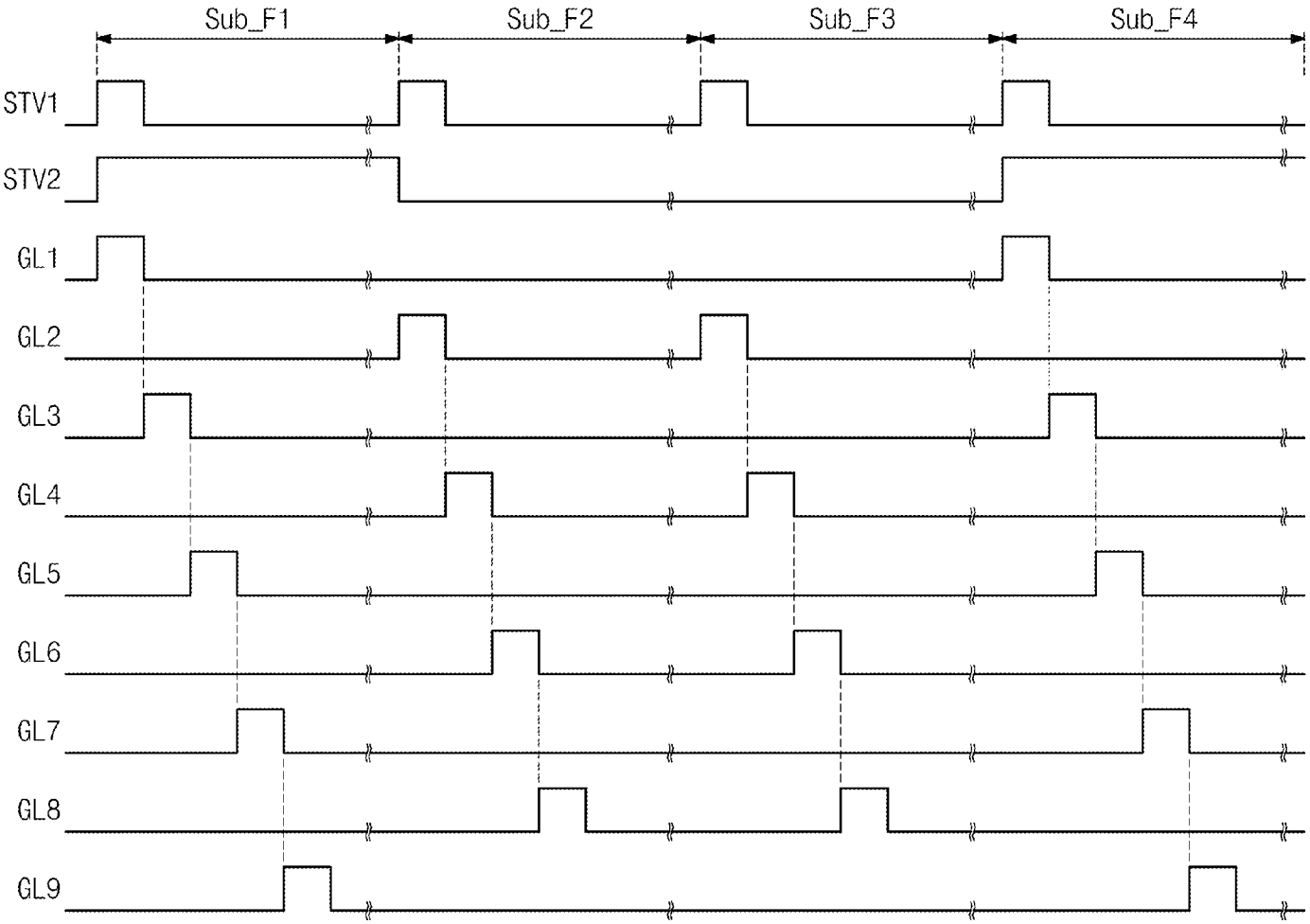
FIG. 9 is a waveform diagram showing a vertical start signal a selection signal, and first to ninth gate signals shown in FIGS. 8A to 8D.

FIGS. 8A to 8D are views showing a relation between sub-frames and the operation of the gate driver 180 and the switching part 190 shown in FIG. 7 and FIG. 9 is a waveform diagram showing a vertical start signal STV, a selection signal SL, and first to ninth gate signals shown in FIGS. 8A to 8D.

Referring to FIGS. 8A and 9, the vertical start signal STV is generated in a high state at the start of each sub-frame period. Therefore, the gate driver 180 starts its operation every sub-frame period. Each of the first and second frame periods Fn and Fn+1 has a period width of about 1/60 (ms) and each of the first to fourth sub-frame periods Sub_F1 to Sub_F4 has a period width of about 1/120 (ms). When the gate driver 180 starts its operation every sub-frame period, the gate driver 180 may be operated at a frequency of about 120 Hz.

The gate driver 180 is operated during the first sub-frame period Sub_F1 to sequentially output the n gate signals. The switching part 190 receives the selection signal. As an example, the switching part 190 includes first switching devices ST1 connected to the odd-numbered gate lines GL1, GL3, GL5, GL7, and GL9 among the gate lines GL1 to GL2*n* and second switching devices ST2 connected to the even-numbered gate lines GL2, GL4, GL6 and GL8 among the gate lines GL1 to GL2*n*. Each of the first switching devices ST1 is an N-type transistor and each of the second switching devices ST2 is a P-type transistor. When the selection signal SL is in a high state, the first switching devices ST1 are turned on, but the second switching devices ST2 are turned off. Thus, the n gate signals sequentially output from the gate driver 190 are sequentially applied to the odd-numbered gate lines GL1, GL3, GL5, GL7, and GL9, i.e., first, third, fifth, seventh, and ninth gate lines, among the gate lines GL1 to GL2*n*.

Accordingly, the pixels connected to the first, third, fifth, seventh, and ninth gate lines GL1, GL3, GL5, GL7, and GL9 are turned on and display a first grayscale image L1. However, since the second switching devices ST2 are turned off, the pixels connected to the even-numbered gate lines GL2, GL4, GL6, and GL8 maintain a previous grayscale image during the first sub-frame period Sub_F1.

Referring to FIGS. 8B and 9, the selection signal SL is transitioned to a low state at the start of the second sub-frame period Sub_F2. Therefore, the first switching devices ST1 are turned off during the second sub-frame period Sub_F2 and the second switching devices ST2 are turned on during the second sub-frame period Sub_F2. The gate signals output from the gate driver 180 are sequentially applied to the second, fourth, sixth, and eighth gate lines GL2, GL4, GL6, and GL8 among the gate lines GL1 to GL2*n* through the second switching devices ST2 as the second, fourth, sixth, and eighth gate signals.

Thus, the pixels arranged in the even-numbered pixel rows connected to the even-numbered gate lines GL2, GL4, GL6, and GL8 receive the data signal corresponding to the fourth grayscale image H2 from the data driver 170.

The first switching devices ST1 are turned off during the second sub-frame period Sub_F2. Accordingly, a new data signal is not applied to the pixels of the odd-numbered pixel rows connected to the odd-numbered gate lines GL1, GL3, GL5, GL7, and GL9, and thus the pixels of the odd-numbered pixel rows maintain the data signal that was previously received.

Referring to FIGS. 8C and 9, the selection signal SL is maintained in the low state during the third sub-frame period Sub_F3 and the gate driver 180 starts its operation when the third sub-frame period Sub_F3 starts. Therefore, the gate signals output from the gate driver 180 are sequentially applied to the second, fourth, sixth, and eighth gate lines GL2, GL4, GL6, and GL8 through the switching part 190.

Thus, the pixels arranged in the even-numbered pixel rows connected to the even-numbered gate lines GL2, GL4, GL6, and GL8 receive the data signal corresponding to the third grayscale image L2 from the data driver 170.

The first switching devices ST1 are turned off during the third sub-frame period Sub_F3. Accordingly, a new data signal is not applied to the pixels of the odd-numbered pixel rows connected to the odd-numbered gate lines GL1, GL3, GL5, GL7, and GL9, and thus the pixels of the odd-numbered pixel rows maintain the data signal previously applied thereto.

Referring to FIGS. 8D and 9, the selection signal SL is transitioned to the high state at the start of the fourth sub-frame period Sub_F4. Therefore, the first switching devices ST1 are turned on and the second switching devices ST2 are turned off. The gate signals output from the gate driver 180 are sequentially applied to the first, third, fifth, seventh, and ninth gate lines GL1, GL3, GL5, GL7, and GL9 through the first switching devices ST1.

Thus, the pixels arranged in the odd-numbered pixel rows connected to the odd-numbered gate lines GL1, GL3, GL5, GL7, and GL9 receive the data signal corresponding to the second grayscale image H1 from the data driver 170.

The second switching devices ST2 are turned off during the fourth sub-frame period Sub_F4. Accordingly, a new data signal is not applied to the pixels of the even-numbered pixel rows connected to the even-numbered gate lines GL2, GL4, GL6, and GL8, and thus the pixels of the even-numbered pixel rows maintain the data signal that was previously received.

Figure 10:
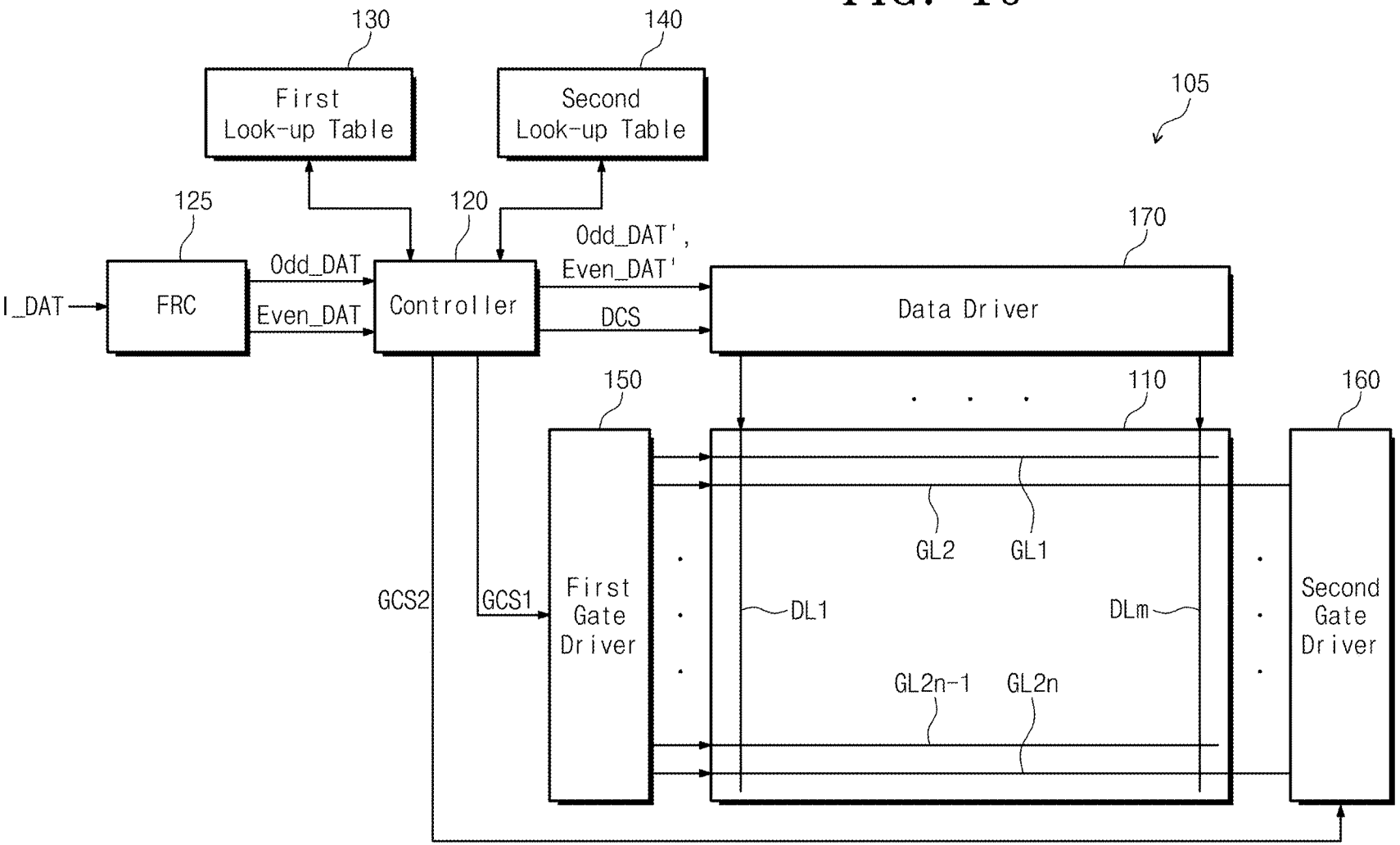
FIG. 10 is a block diagram showing a display apparatus according to another exemplary embodiment of the present disclosure.

FIG. 10 is a block diagram showing a display apparatus 105 according to another exemplary embodiment of the present disclosure. In FIG. 10, the same reference numerals denote the same elements in FIG. 1, and thus detailed descriptions of the same elements will be omitted.

Referring to FIG. 10, the display apparatus 105 includes a display panel 110, a frame rate controller (hereinafter, referred to as FRC) 125, a controller 120, first and second gate drivers 150 and 160, and a data driver 170.

The display apparatus 105 has the same structure and function as those of the display apparatus 101 shown in FIG. 1 except that the display apparatus 105 further includes the FRC 125. The FRC 125 receives input image data I_DAT from the outside of the display apparatus 105, separates the input image data I_DAT into first and second input image data Odd_DAT and Even_DAT, and applies the first and second input image data Odd_DAT and Even_DAT to the controller 120. That is, the FRC 125 increases the frame frequency to time-divide an input frame period into two or more sub-frame periods. That is, the FRC 125 divides the image related to the pixel of each sub-frame period in accordance with each sub-frame period.

Since the data processing process and the driving process by the controller 120, the first and second gate drivers 150 and 160, and the data driver 170 are substantially the same as those of the display apparatus 101 shown in FIG. 1.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display apparatus comprising: a plurality of pixels, a first pixel group of the pixels configured to display a first grayscale image based on a first gamma curve during three sub-frame periods among consecutive first, second, third, and fourth sub-frame periods and configured to display a second grayscale image based on a second gamma curve during a remaining one sub-frame period of the first, second, third, and fourth sub-frame periods, a second pixel group of the pixels configured to display a third grayscale image based on the first gamma curve during three sub-frame periods among the first, second, third, and fourth sub-frame periods and configured to display a fourth grayscale image based on the second gamma curve during a remaining one sub-frame period of the first, second, third, and fourth sub-frame periods, wherein the sub-frame period in which the first pixel group displays the second grayscale image is different from the sub-frame period in which the second pixel group displays the fourth grayscale image.

2. The display apparatus of claim 1, wherein the pixels are arranged in a matrix form, the display apparatus further comprises a plurality of gate lines arranged in a row direction and sequentially scanned in the row direction, and the first and second pixel groups are alternately arranged with each other in the row direction.

3. The display apparatus of claim 2, wherein the first pixel group comprises odd-numbered pixel rows among the pixels, the odd-numbered pixel rows are sequentially turned on in a column direction to display the first grayscale image during the first subframe period, the second pixel group comprises even-numbered pixel rows among the pixels, and the even-numbered pixel rows are sequentially turned on in the column direction to display the third grayscale image during the second sub-frame period.

4. The display apparatus of claim 3, wherein the first pixel group maintains the first grayscale image during the second and third sub-frame periods.

5. The display apparatus of claim 4, wherein the even-numbered pixel rows are sequentially turned on in the column direction to display the fourth grayscale image during the second sub-frame period.

6. The display apparatus of claim 5, wherein the odd-numbered pixel rows are sequentially turned on in the column direction to display the second grayscale image during the fourth sub-frame period.

7. The display apparatus of claim 3, further comprising: a first gate driver connected to odd-numbered gate lines among the gate lines to sequentially drive the odd-numbered pixel rows; and a second gate driver connected to even-numbered gate lines among the gate lines to sequentially drive the even-numbered pixel rows.

8. The display apparatus of claim 7, wherein the first and second gate drivers are alternately operated with each other, the first gate driver is operated during the first and fourth sub-frame periods, and the second gate driver is operated during the second and third sub-frame periods.

9. The display apparatus of claim 8, wherein the first gate driver receives a first vertical start signal generated in a high state at a start of the first sub-frame period and a start of the fourth sub-frame period, and the second gate driver receives a second vertical start signal generated in a high state at a start of the second sub-frame period and a start of the third sub-frame period.

10. The display apparatus of claim 1, further comprising: 2n gate lines: a gate driver configured to sequentially output n gate signals during each of the first, second, third, and fourth sub-frame periods; and a switching part disposed between the gate driver and the 2n gate lines to switch the 2n gate lines.

11. The display apparatus of claim 10, wherein the switching part selects odd-numbered gate lines among the 2n gate lines during the first and fourth sub-frame periods to sequentially apply the n gate signals to the odd-numbered gate lines and selects even-numbered gate lines among the 2n gate lines during the second and third sub-frame periods to sequentially apply then gate signals to the even-numbered gate lines.

12. The display apparatus of claim 1, wherein the first and second gamma curves have different brightness values from each other at a same grayscale level.

13. The display apparatus of claim 12, wherein the first gamma curve has a brightness value lower than a brightness value of the second gamma curve at the same grayscale level.

14. A method of driving a display apparatus comprising a plurality of pixels displaying an image during consecutive first, second, third, and fourth sub-frame periods, comprising: displaying a first grayscale image on the basis of a first gamma curve during three sub-frame periods of the first, second, third, and fourth sub-frame periods by a first pixel group of the pixels and displaying a second gray scale image on the basis of a second gamma curve during a remaining one sub-frame period of the first, second, third, and fourth sub-frame periods by the first pixel group; and displaying a third grayscale image on the basis of the first gamma curve during three sub-frame periods of the first, second, third, and fourth sub-frame periods by a second pixel group of the pixels and displaying a fourth gray scale image on the basis of the second gamma curve during a remaining one sub-frame period of the first, second, third, and fourth sub-frame periods by the second pixel group, wherein the sub-frame period in which the first pixel group displays the second grayscale image is different from the subframe period in which the second pixel group displays the fourth grayscale image.

15. The method of claim 14, wherein the first and second gamma curves have different brightness values from each other at a same grayscale level.

16. The method of claim 15, wherein the first gamma curve has a brightness value lower than a brightness value of the second gamma curve at the same grayscale level.

17. The method of claim 15, wherein each of the first, second, third, and fourth sub-frames has a period width of about 1/120 (ms).

18. The method of claim 14, wherein the first pixel group comprises odd-numbered pixel rows of the pixels and the odd-numbered pixel rows are sequentially turned on in a column direction to display the first grayscale image during the first subframe period.

19. The method of claim 18, wherein the first pixel group maintains the first grayscale image during the second and third sub-frame periods.

20. The method of claim 18, wherein the second pixel group comprises even-numbered pixel rows among the pixels and the even-numbered pixel rows are sequentially turned on in the column direction to display the fourth grayscale image during the second sub-frame period.

21. The method of claim 20, wherein the even-numbered pixel rows are sequentially turned on in the column direction to display the third grayscale image during the third sub-frame period.

22. The method of claim 21, wherein the odd-numbered pixel rows are sequentially turned on in the column direction to display the second grayscale image during the fourth sub-frame period.

* * * * *